United States Patent [19]

Hawk et al.

[11] 4,231,721

[45] Nov. 4, 1980

[54] DIAPHRAGM PUMP

[75] Inventors: Rufus L. Hawk, Xenia; Ralph D. Unterborn, Dayton, both of Ohio

[73] Assignee: General Motors Corporation, Detroit, Mich.

[21] Appl. No.: 950,722

[22] Filed: Oct. 12, 1978

[51] Int. Cl.[3] ..... F04B 43/04

[52] U.S. Cl. ..... 417/413; 74/56; 15/250.02

[58] Field of Search ..... 74/56; 15/250.02; 417/413

[56] References Cited

U.S. PATENT DOCUMENTS

| | | | |
|---|---|---|---|
| 1,588,832 | 6/1926 | Young | 74/56 |
| 2,819,678 | 1/1958 | Nordell | 74/56 |
| 3,134,125 | 5/1964 | Kaiser | 417/413 |
| 3,152,726 | 10/1964 | Chivers | 15/250.02 |
| 3,153,347 | 10/1964 | Schulze | 74/56 |
| 3,164,024 | 1/1965 | Tarry et al. | 74/56 |

FOREIGN PATENT DOCUMENTS

| | | | |
|---|---|---|---|
| 431237 | 7/1935 | United Kingdom | 74/56 |
| 1051929 | 12/1966 | United Kingdom | 15/250.02 |

*Primary Examiner*—William L. Freeh
*Attorney, Agent, or Firm*—F. J. Fodale

[57] ABSTRACT

A diaphragm pump comprises a diaphragm peripherally mounted in a housing to define a pump chamber and a gear chamber. A cam follower is reciprocably mounted in the gear chamber and secured to the diaphragm. A rotary cam-gear rotatably mounted in the gear chamber has an annular cam face engaging the cam follower to reciprocate the diaphragm when driven by an electric motor through a single stage reduction gear set. A compression spring located in the pump chamber expands the pump chamber and maintains the cam follower in engagement with the cam face.

1 Claim, 5 Drawing Figures

DIAPHRAGM PUMP

This invention relates generally to a diaphragm pump and more particularly to the mechanism for actuating the diaphragm.

Automobiles have many accessories, such as air conditioning controls which are vacuum operated using the engine manifold vacuum as a power source. Engines of the future possibly may not be able to supply vacuum power requirements, particularly if additional vacuum powered accessories or devices are incorporated in future automobiles. Consequently automobiles of the future may require an additional vacuum power source which can be fit into an already crowded engine compartment. A very logical combination is a diaphragm pump driven by an electric motor since electric power is readily available in the automobile. Most diaphragm pumps known today have bulky and complex arrangements for actuating the diaphragm which are not especially suitable for being driven by an electric motor. Examples of these prior art arrangements are disclosed in U.S. Pat. No. 1,981,667 granted to Edward A. Rockwell Nov. 20, 1934 for a "Fuel Pumping Device" and U.S. Pat. No. 2,104,446 granted to Abraham M. Babitch and Gordon W. Harry Jan. 4, 1938 for a "Fuel Pump".

The object of this invention is to provide a diaphragm pump having a diaphragm actuating mechanism which is simple, conpact and especially adapted to be driven by an electric motor.

Figure 1:
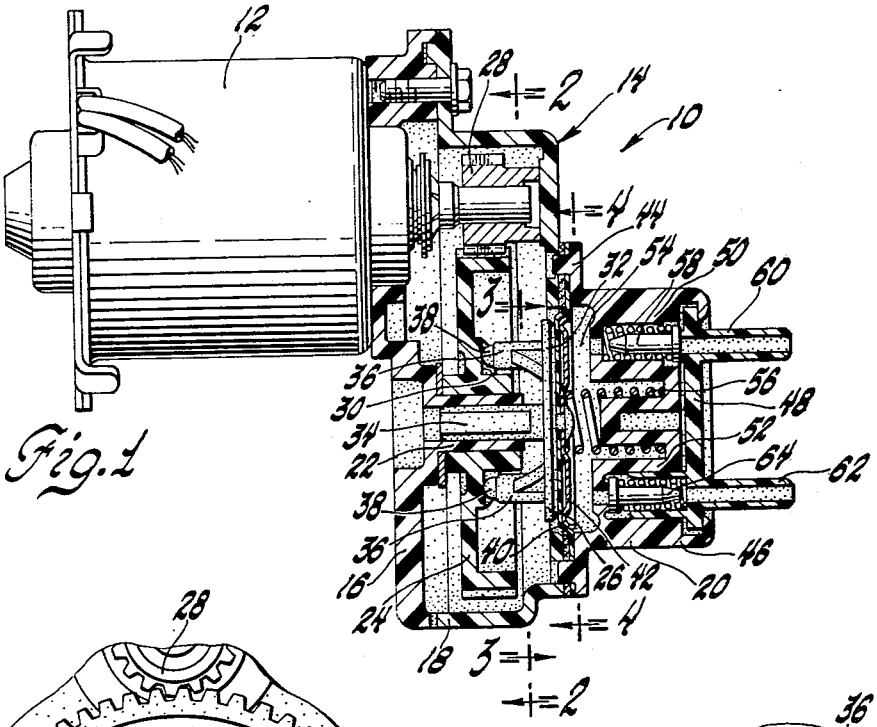
Figure 2:
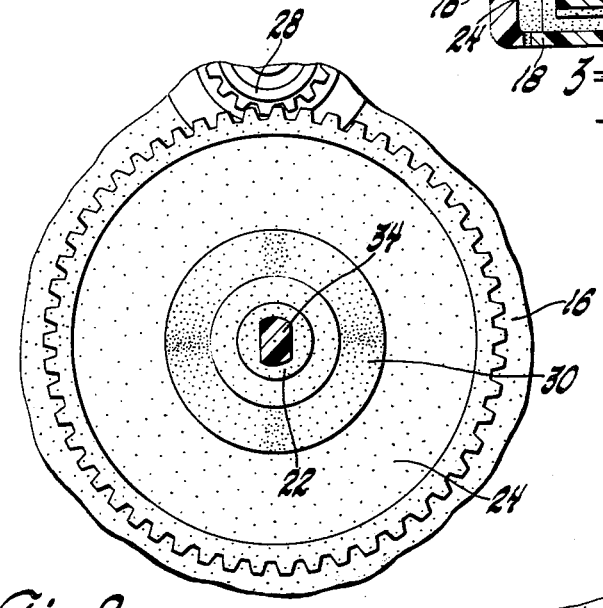
Figure 3:
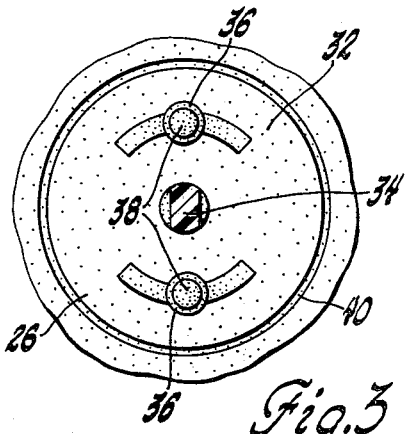
Figure 4:
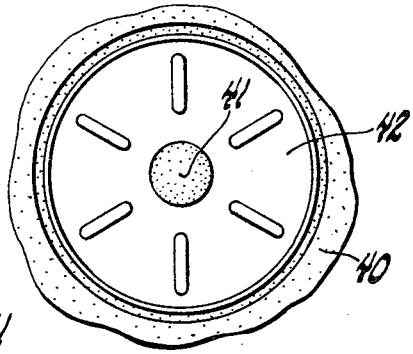
Figure 5:
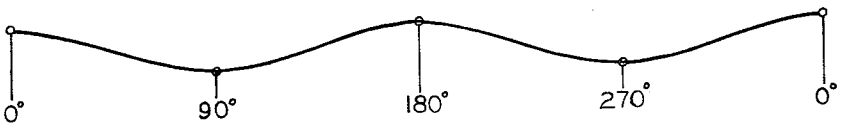

Other objects and features of the invention will become apparent to those skilled in the art as the disclosure is made in the following detailed description of a preferred embodiment of the invention as illustrated in the accompanying sheet of drawing in which:

FIG. 1 is a side sectional view of an assembly having a diaphragm pump in accordance with this invention, FIG. 2 is a section view taken substantially along the line 2—2 of FIG. 1 looking in the direction of the arrows, FIG. 3 is a section view taken substantially along the line 3—3 of FIG. 1 looking in the direction of the arrows, FIG. 4 is a section view taken substantially along the line 4—4 of FIG. 1 looking in the direction of the arrows, and FIG. 5 is a graphical representation of the cam profile.

Referring now to FIG. 1, the diaphragm pump 10 of this invention is illustrated in conjunction with an electric drive motor 12. The diaphragm pump 10 comprises a three-piece housing assembly 14 consisting of a mounting plate 16, gear housing 18 and a valve assembly 20.

The mounting plate 16 has an upper bore which receives a reduced end portion of the electric motor 12 and is secured to the surrounding casing by bolts or the like. The mounting plate 16 also has a lower integral hollow stud 22 which serves as a journal for a rotary cam-gear 24 and a slide for a reciprocable cam follower 26.

The rotary cam-gear 24 has teeth on its periphery and a cam face 30 and thus constitutes both a reduction gear driven by a pinion gear 28 on the output shaft of the electric motor 12 and a rotary cam. The cam face 30 is sinusoidal as illustrated graphically in FIG. 5 and provides two complete stroke cycles of the diaphragm per revolution of the rotary cam. The gear housing 18 is bolted to the mounting plate 16 to house the single stage reduction gear set 24, 28 (including the integrated rotary cam) and the reciprocable cam follower 26.

The gear housing 18 has an enlarged opening concentric with the hollow stud 22 which is covered by a flexible diaphragm 40 forming part of a diaphragm assembly which includes the cam follower 26. The cam follower 26 comprises a plate 32, a stem 34 and a pair of studs 36 radially spaced from the stem 34 diametrically opposite each other. The stem 34 and the bore of the hollow stud 22 have matching non-circular cross sections to permit reciprocation while preventing rotation relative to the housing assembly 14. The studs 36 carry round buttons 38 for point contact with the cam face 30.

The center section of flexible diaphragm 40 is firmly sandwiched between the plate 32 and a sheet metal plate 42 which is secured to the plate 32 by a central heat staked portion 41. The outer periphery of the flexible diaphragm 40 carries a bonded gasket and is clamped between the side wall portions surrounding the opening of the gear housing 18 and a flange 44 of the valve assembly 20 secured to the gear housing by bolts or the like (not shown).

The flange 44 has a pair of studs which cooperate with holes in the diaphragm periphery, the gasket and the gear housing to properly orient the diaphragm assembly, the valve assembly and the gear housing with respect to each other.

The valve assembly 20 comprises a pump housing 46 and a valve cover 48. The pump housing 46 includes two integral valve bodies 50 and 52 communicating with a pump chamber 54 formed in conjunction with the diaphragm 40. A compression spring 56 is disposed in the pump chamber 54 around a central locating stud of the pump housing 46. The compression spring 56 engages the sheet metal plate 42 to expand the pump chamber 54 and bias the cam follower 26 against the cam face 30.

The valve body 50 carries a spring biased inlet valve 58 seated against the end of a cover inlet tube 60. The valve body 52 communicates with a cover outlet tube 62 and carries a spring biased outlet valve 64 seated against an internal outlet.

In operation, the electric motor 12 rotates the sinusoidal cam face 30 at a reduced speed which in turn reciprocates the central portion of the diaphragm 40 intermittently sucking air or the like into the chamber 54 through the inlet tube 60 past inlet valve 58 and expelling it out through the outlet tube 62 past the outlet valve 64.

The diaphragm pump of this invention provides an extremely compact and unique mechanism for the actuation of the diaphragm which is especially suitable for being driven by an electric motor.

We wish it to be understood that we do not desire to be limited to the exact details of construction shown and described, for obvious modifications will occur to a person skilled in the art.

What is claimed is:

1. In a diaphragm pump having a housing, a diaphragm peripherally mounted in said housing to define a pump chamber, and inlet and outlet means communicating with said pump chamber, the improvement comprising:

a support plate forming part of the housing having a hollow stud which projects into a second chamber of the housing defined in part by the diaphragm, a cam follower disposed in the second chamber and secured to a central portion of the diaphragm, said cam follower having a stem reciprocably and non-rotatably mounted in the hollow stud and a pair of round ended studs radially spaced from the stem and diametrically opposite each other, a cam-gear disposed in the second chamber and rotatably mounted on the hollow stud on an axis concentric with the cam follower and diaphragm, said cam-gear having an annular sinusoidal cam face engaging said pair of round ended studs to reciprocate the diaphragm as the cam-gear is rotated, compression spring means disposed in the pump chamber engaging the diaphragm to expand the pump chamber and maintain the pair of round ended studs in engagement with the cam face, and means on the support plate for mounting a motor and receiving the motor output shaft and an attached drive pinion in the second chamber for driving the cam-gear at a reduced speed.

* * * * *